US011234892B2

(12) United States Patent
Kenyon

(10) Patent No.: US 11,234,892 B2
(45) Date of Patent: Feb. 1, 2022

(54) HEATED MASSAGE TOOL

(71) Applicant: Bruce D. Kenyon, Boulder, CO (US)

(72) Inventor: Bruce D. Kenyon, Boulder, CO (US)

( * ) Notice: Subject to any disclaimer, the term of this patent is extended or adjusted under 35 U.S.C. 154(b) by 284 days.

(21) Appl. No.: 16/503,606

(22) Filed: Jul. 4, 2019

(65) Prior Publication Data

US 2020/0009005 A1 Jan. 9, 2020

Related U.S. Application Data

(60) Provisional application No. 62/694,224, filed on Jul. 5, 2018.

(51) Int. Cl.
*A61H 7/00* (2006.01)

(52) U.S. Cl.
CPC ..... *A61H 7/007* (2013.01); *A61H 2201/0207* (2013.01); *A61H 2201/0228* (2013.01); *A61H 2201/1253* (2013.01); *A61H 2201/50* (2013.01)

(58) Field of Classification Search
CPC ..... A61H 7/007; A61H 2201/0207; A61H 2201/0228; A61H 2201/1253; A61H 2201/50
See application file for complete search history.

(56) References Cited

U.S. PATENT DOCUMENTS

| | | | | | |
|---|---|---|---|---|---|
| 3,382,866 | A * | 5/1968 | Ramsay | A61H 7/003 601/19 |
| 3,831,592 | A * | 8/1974 | Lancellotti | A61H 39/04 601/135 |
| 4,082,089 | A * | 4/1978 | Moriyama | A61F 7/007 601/19 |
| 4,291,685 | A * | 9/1981 | Taelman | A45D 40/26 219/227 |
| 4,452,237 | A * | 6/1984 | Lewis | A61H 39/04 601/134 |
| 5,843,005 | A * | 12/1998 | Chubinsky | A61H 7/003 601/15 |
| D586,470 | S * | 2/2009 | Warder | D24/211 |

* cited by examiner

*Primary Examiner* — Steven O Douglas
(74) *Attorney, Agent, or Firm* — F. Chau & Associates, LLC

(57) ABSTRACT

A method and apparatus for massage therapy is described. The method may include using the apparatus to apply heat and pressure to a subject's body. The apparatus may include a handle, a stem connected to the handle, a pusher tip connected to the stem, and an electric heating element configured to increase the temperature of the pusher tip. The heating element may be used to heat the pusher tip so that a precise amount of heat and pressure may be applied to a subject's body during massage therapy.

17 Claims, 4 Drawing Sheets

HEATED MASSAGE TOOL

This application claims priority to, and the benefit of, U.S. Provisional Application Ser. No. 62/694,224 filed on Jul. 5, 2018, entitled HEATED MASSAGE TOOL. The entire contents of the foregoing application are hereby incorporated by reference for all purposes.

BACKGROUND

The following relates generally to physical therapy, and more specifically to massage therapy using a heated massage tool.

Many therapists use tools to apply pressure to the subject's body during a massage. They may also utilize heated objects such as rocks to manipulate the temperature of the skin and underlying tissue. However, in some cases it is challenging to achieve the desired temperature of a heated object for a sustained period of time, and to accurately apply the temperature to specific parts of the body. This may result in delays, or in reduced effectiveness of the therapy.

SUMMARY

An apparatus for massage therapy is described. The apparatus may include a handle, a stem connected to the handle, a pusher tip connected to the stem, and an electric heating element configured to increase the temperature of the pusher tip. The heating element may be used to heat the tip so that a precise amount of heat and pressure may be applied to a subject's body during massage therapy.

A method of manufacturing a heated massage tool is described. The method may include providing a handle, providing a stem connected to the handle, providing a pusher tip connected to the stem, and providing an electric heating element configured to increase the temperature of the pusher tip.

A method of using a heated massage tool is described. The method may include using a handle, using a stem connected to the handle, using a pusher tip connected to the stem, and using an electric heating element configured to increase the temperature of the pusher tip.

Some examples of the apparatus and method described above may further include a rheostat in electronic communication with the electric heating element, and configured to adjust a temperature of the electric heating element. In some examples of the apparatus and method described above, the rheostat is connected to a temperature control element. In some examples of the apparatus and method described above, the rheostat is configured to limit the temperature of the electric heating element below a maximum heating level.

In some examples of the apparatus and method described above, the stem is perpendicular to the handle. Some examples of the apparatus and method described above may further include an angle separating the stem and the handle is between 45 degrees and 90 degrees. In some examples of the apparatus and method described above, the pusher tip is removably connected to the stem. In some examples of the apparatus and method described above, the stem comprises helical threading, and the pusher tip comprises a threaded hole configured to mate with the helical threading of the stem.

Some examples of the apparatus and method described above may further include a battery configured to provide power to the electric heating element. Some examples of the apparatus and method described above may further include a battery holder configured to secure the battery within the handle. Some examples of the apparatus and method described above may further include a battery charger configured to recharge the battery. Some examples of the apparatus and method described above may further include a power plug configured to draw power from a power receptacle and provide power to the electric heating element.

In some examples of the apparatus and method described above, the handle comprises a hollow cylinder. Some examples of the apparatus and method described above may further include at least a portion of the electric heating element is located within the hollow cylinder of the handle.

DETAILED DESCRIPTION

An electronically heated massage tool for the purpose of therapeutic massage is described. The massage tool may be used for self massage, or on others. In some embodiments, the shape of the massage tool may resemble a classic wooden T-bar as illustrated in the following detailed description. However, other shapes are also possible. The electronically heated massage tool may facilitate massage techniques that utilize depth, sustained pressure and heat.

For example, the electronically heated massage tool may be used during Myofascial release, Neuromuscular massage, and Acupressure. The electronically heated massage tool may be substantially easier and quicker than existing techniques for applying heat during massage therapy. The heating element may heat up in a few seconds, and with a turn of the dial. In some cases, different tips may be available for different surfaces of the body. The pusher tips may be removable and interchangeable.

Figure 1:
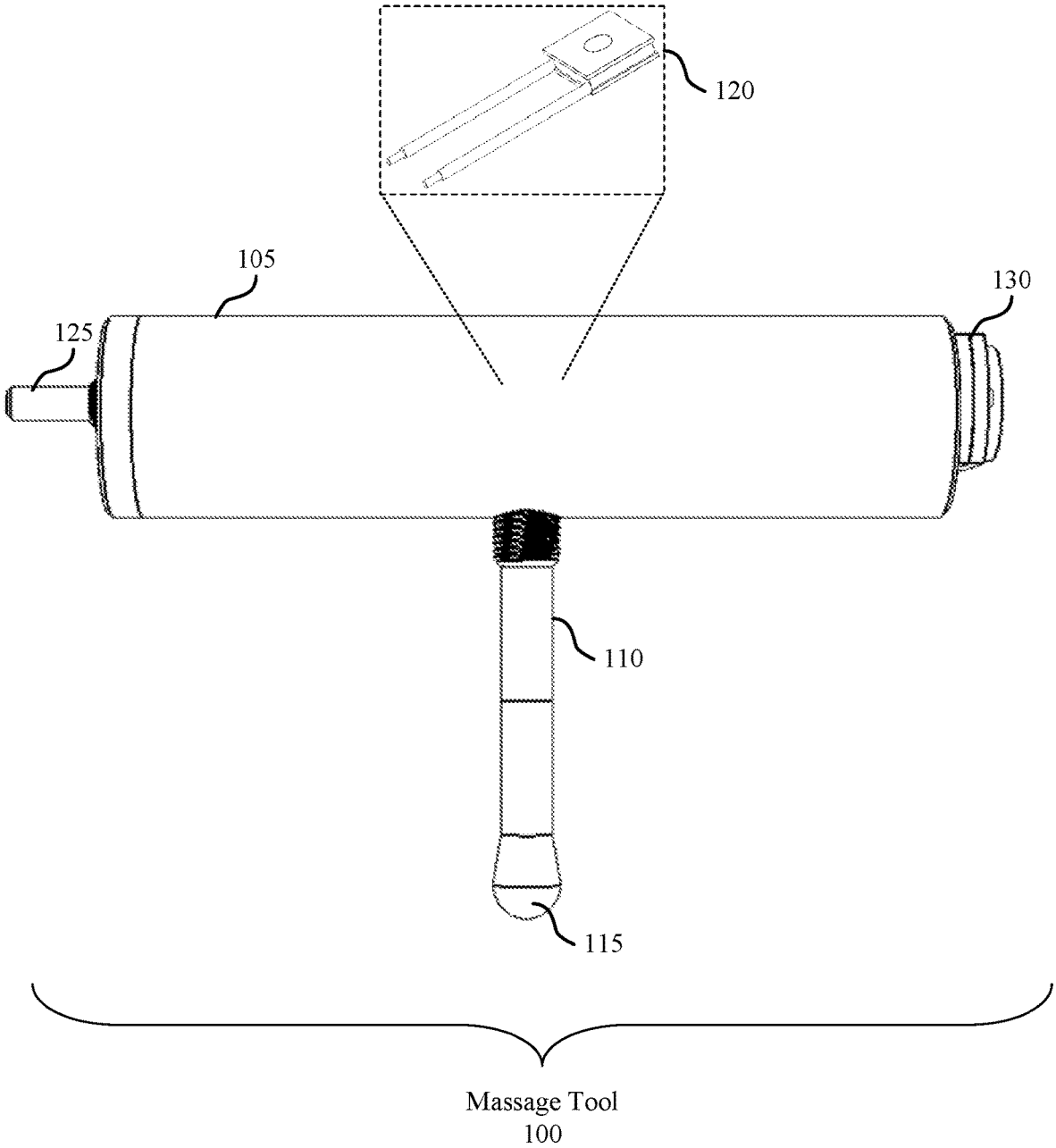
FIG. 1 shows an example of a front view of a massage tool in accordance with aspects of the present disclosure.

FIG. 1 shows an example of a front view of a massage tool 100 in accordance with aspects of the present disclosure. The example shown includes massage tool 100, which may include handle 105, stem 110, pusher tip 115, heating element 120, rheostat 125, and battery holder 130. Massage tool 100 may be an example of, or include aspects of, the corresponding element described with reference to FIG. 2.

A user, such as a massage therapist, may use handle 105 to grip massage tool 100, where the handle 105 is connected to stem 110. Then, the user may apply pressure to a subject's body using pusher tip 115. Heat may also be applied to the subject's body using an electric heating element 120 located within the massage tool 100.

The massage tool 100 may be manufactured from a rigid material such as metal (e.g., aluminum), plastic, rubber, or wood. In some cases, different components of the massage tool 100 may be made from different materials. In some examples, the handle 105 comprises a hollow cylinder. Handle 105 may be an example of, or include aspects of, the corresponding element described with reference to FIG. 2.

The stem 110 may be connected to the handle 105. The stem 110 may also be and the handle 105 is between 45 degrees and 90 degrees. In some examples, the stem 110 is perpendicular to the handle 105. In some examples, the stem 110 comprises helical threading, and the pusher tip 115 comprises a threaded hole configured to mate with the helical threading of the stem 110. Stem 110 may be an example of, or include aspects of, the corresponding element described with reference to FIG. 2.

The pusher tip 115 may be connected to the stem 110. In some examples, the pusher tip 115 is removably connected to the stem 110. Pusher tip 115 may be an example of, or include aspects of, the corresponding element described with reference to FIG. 2.

The heating element 120 may be configured to increase the temperature of the pusher tip 115. For example, heating element 120 may convert energy into heat through the process of resistive or Joule heating. In some examples, the heating element 120 may be located within the hollow cylinder of the handle 105. In other examples, the heating element 120 may be located within stem 110 or pusher tip 115 or between these components. Heating element 120 may be an example of, or include aspects of, the corresponding element described with reference to FIG. 2.

The rheostat 125 may be in electronic communication with the electric heating element 120, and configured to adjust a temperature of the electric heating element 120. In some examples, the rheostat 125 may be connected to a temperature control element (e.g., a dial or a digital control). In some examples, the rheostat 125 is configured to limit the temperature of the electric heating element 120 below a maximum heating level. Thus, rheostat 125 may provide adjustable heat, which may be limited to a certain temperature that is safe for application to the skin (e.g., 122 degrees). In some cases, the rheostat 125 may be a rotary potentiometer. Also, rheostat 125 may be configured with a click control to turn the heat on and off, and massage tool 100 may also include a timer or a warning system to ensure that the heat is not left on (not shown). Rheostat 125 may be an example of, or include aspects of, the corresponding element described with reference to FIG. 2.

In some example, the heating element 120 may be powered by a battery. A battery is a device that stores and discharges energy through the controlled conversion of chemical energy to electric energy. Energy is stored by preventing the flow of electrons between chemical reactants with different electric potential. Energy is released when electrons are allowed to flow between a positive terminal (cathode) and a negative terminal (anode). When the terminals are connected, the compounds undergo chemical reactions that are known as oxidation and reduction. The chemical reactions may cause a flow of electrolytes and drive current through the heating element 120. In some examples, size AA batteries may be used, although other sizes may also be used.

When the heating element 120 is powered by a battery, a battery holder 130 may be configured to secure the battery within the handle 105. Battery holder 130 may be an example of, or include aspects of, the corresponding element described with reference to FIG. 2. In some cases, massage tool 100 may also include of a battery charger configured to recharge the battery.

Figure 2:
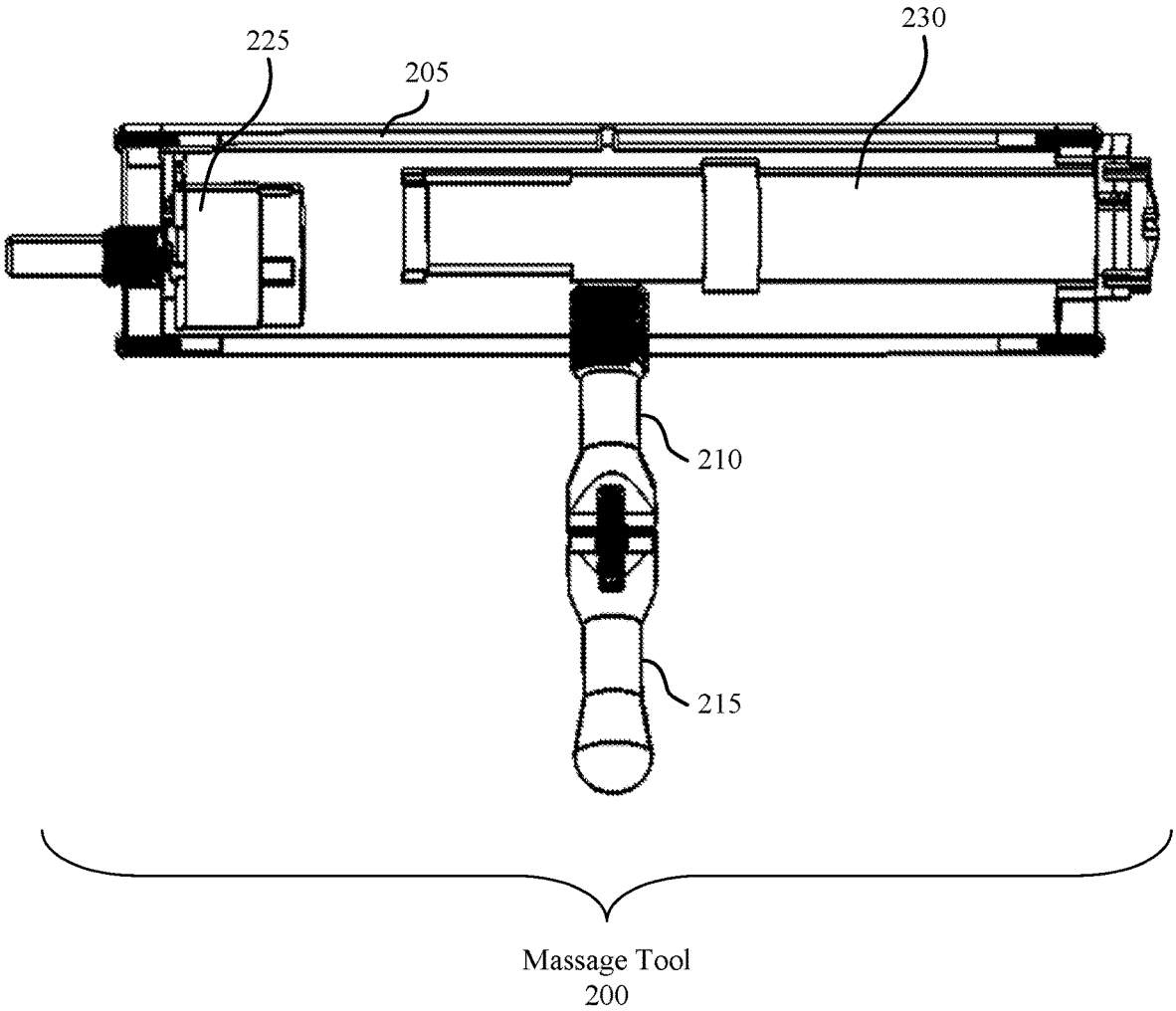
FIG. 2 shows an example of a cross sectional view of a massage tool in accordance with aspects of the present disclosure.

FIG. 2 shows an example of a cross sectional view of a massage tool 200 in accordance with aspects of the present disclosure. The example shown includes massage tool 200. Massage tool 200 may include handle 205, stem 210, pusher tip 215, a heating element (not shown), rheostat 225, and battery holder 230. Massage tool 200 may be an example of, or include aspects of, the corresponding element described with reference to FIG. 1.

In some examples, the handle 205 comprises a hollow cylinder, such that the a heating element (not shown), rheostat 225, and battery holder 230 are located within the handle 205 as illustrated. Handle 205 may be an example of, or include aspects of, the corresponding element described with reference to FIG. 1.

The stem 210 may be connected to the handle 205. Stem 210 may be an example of, or include aspects of, the corresponding element described with reference to FIG. 1. The pusher tip 215 may be connected to the stem 210. Pusher tip 215 may be an example of, or include aspects of, the corresponding element described with reference to FIG. 1.

The rheostat 225 may be in electronic communication with the electric heating element 220, and configured to adjust a temperature of the electric heating element 220. Rheostat 225 may be an example of, or include aspects of, the corresponding element described with reference to FIG. 1.

The battery holder 230 may be configured to secure the battery within the handle 205. Battery holder 230 may be an example of, or include aspects of, the corresponding element described with reference to FIG. 1.

Figure 3:
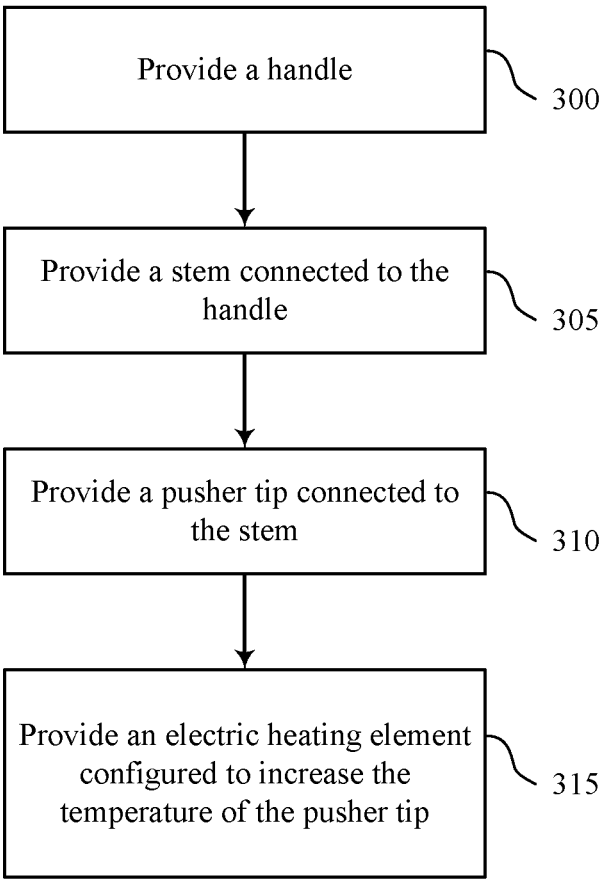
FIG. 3 shows an example of a process for manufacturing a heated massage tool in accordance with aspects of the present disclosure.

FIG. 3 shows an example of a process for manufacturing a heated massage tool in accordance with aspects of the present disclosure. In some examples, these operations may be performed manually, by a human controlled machine, or by a machine with a processor executing a set of codes to control functional elements of an apparatus. Additionally or alternatively, the processes may be performed using special-purpose hardware. Generally, these operations may be performed according to the methods and processes described in accordance with aspects of the present disclosure. For example, the operations may be composed of various sub-steps, or may be performed in conjunction with other operations described herein.

At step 300, a manufacturing system may provide a handle. At step 305, a manufacturing system may provide a stem connected to the handle. At step 310, a manufacturing system may provide a pusher tip connected to the stem. At step 315, a manufacturing system may provide an electric heating element configured to increase the temperature of the pusher tip.

In some examples, the heated massage tool may include a Battery, a Battery Management System (BMS), a Cartridge Heater, a Resistor, a Rectifier, a Barrel Jack, a Push Switch, and a length of wire.

Figure 4:
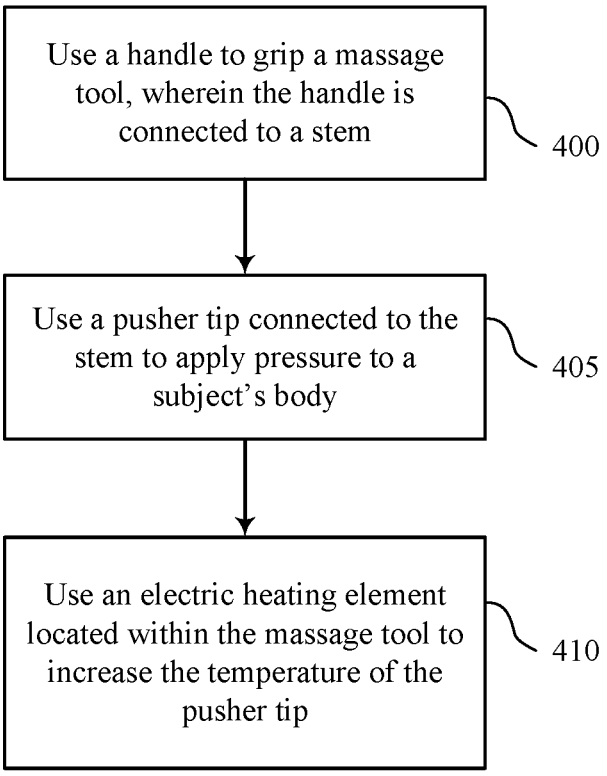
FIG. 4 shows an example of a method of massage in accordance with aspects of the present disclosure.

FIG. 4 shows an example of a method of massage in accordance with aspects of the present disclosure At step 400, a system may use a handle to grip a massage tool, wherein the handle is connected to a stem. In some cases, the operations of this step may be performed using a massage tool with a handle and stem as described with reference to FIGS. 1 and 2.

At step 405, a system may use a pusher tip connected to the stem to apply pressure to a subject's body. In some cases, the operations of this step may be performed using a pusher tip as described with reference to FIGS. 1 and 2.

At step 410, a system may use an electric heating element located within the massage tool to increase the temperature of the pusher tip and apply heat to the subject's body. In some cases, the operations of this step may be performed using a heating element as described with reference to FIGS. 1 and 2.

The description and drawings described herein represent example configurations and do not represent all the implementations within the scope of the claims. For example, the operations and steps may be rearranged, combined or otherwise modified. Also, structures and devices may be represented in the form of block diagrams to represent the relationship between components and avoid obscuring the described concepts. Similar components or features may have the same name but may have different reference numbers corresponding to different figures.

Some modifications to the disclosure may be readily apparent to those skilled in the art, and the principles defined herein may be applied to other variations without departing from the scope of the disclosure. Thus, the disclosure is not limited to the examples and designs described herein, but is to be accorded the broadest scope consistent with the principles and novel features disclosed herein.

In this disclosure and the following claims, the word "or" indicates an inclusive list such that, for example, the list of X, Y, or Z means X or Y or Z or XY or XZ or YZ or XYZ. Also the phrase "based on" is not used to represent a closed set of conditions. For example, a step that is described as "based on condition A" may be based on both condition A and condition B. In other words, the phrase "based on" shall be construed to mean "based at least in part on."

What is claimed is:

1. An apparatus for physical therapy, comprising:

a handle comprising a substantially cylindrical shape;

a stem connected to the handle, wherein the stem extends in a direction perpendicular to a height direction of the substantially cylindrical shape of the handle;

a pusher tip connected to the stem, wherein a length of the stem separates a portion of the stem connected to the handle and a portion of the stem connected to the pusher tip in the direction perpendicular to the height direction; and an electric heating element located in the handle and configured to perform resistive heating to increase the temperature of the pusher tip.

2. The apparatus of claim 1, further comprising:

a rheostat in electronic communication with the electric heating element, and configured to adjust a temperature of the electric heating element.

3. The apparatus of claim 2, wherein:

the rheostat is connected to a temperature control element.

4. The apparatus of claim 2, wherein:

the rheostat is configured to limit the temperature of the electric heating element below a maximum heating level.

5. The apparatus of claim 1, wherein:

the pusher tip is removably connected to the stem.

6. The apparatus of claim 5, wherein:

the stem comprises helical threading, and the pusher tip comprises a threaded hole configured to mate with the helical threading of the stem.

7. The apparatus of claim 1, further comprising:

a battery configured to provide power to the electric heating element.

8. The apparatus of claim 7, further comprising:

a battery holder configured to secure the battery within the handle.

9. The apparatus of claim 7, further comprising:

a battery charger configured to recharge the battery.

10. The apparatus of claim 1, further comprising:

a power plug configured to draw power from a power receptacle and provide power to the electric heating element.

11. The apparatus of claim 1, wherein:

the handle comprises a hollow cylinder.

12. A method of manufacturing an apparatus for massage therapy, the method comprising:

providing a handle comprising a substantially cylindrical shape;

providing a stem connected to the handle, wherein the stem extends in a direction perpendicular to a height direction of the substantially cylindrical shape of the handle;

providing a pusher tip connected to the stem, wherein a length of the stem separates a portion of the stem connected to the handle and a portion of the stem connected to the pusher tip in the direction perpendicular to the height direction; and providing an electric heating element in the handle that is configured to perform resistive heating to increase the temperature of the pusher tip.

13. The method of claim 12, the method further comprising:

providing a rheostat in electronic communication with the electric heating element, and configured to adjust a temperature of the electric heating element.

14. The method of claim 12, the method further comprising:

providing a battery configured to provide power to the electric heating element.

15. A method of massage therapy is described, the method comprising:

using a handle to grip a massage tool, wherein the handle comprises a substantially cylindrical shape is connected to a stem that extends in a direction perpendicular to a height direction of the substantially cylindrical shape of the handle;

using a pusher tip connected to the stem to apply pressure to a subject's body, wherein a length of the stem separates a portion of the stem connected to the handle and a portion of the stem connected to the pusher tip in the direction perpendicular to the height direction; and using an electric heating element located within the handle of the massage tool to perform resistive heating to increase the temperature of the pusher tip.

16. The method of claim 15, the method further comprising:

using a rheostat in electronic communication with the electric heating element to adjust a temperature of the electric heating element.

17. The method of claim 16, wherein:

using the rheostat to limit the temperature of the electric heating element below a maximum heating level.

* * * * *